United States Patent [19]

Lumbattis, Jr.

[11] Patent Number: 4,991,839

[45] Date of Patent: Feb. 12, 1991

[54] GOLF CLUB SUPPORT DEVICE

[76] Inventor: John R. Lumbattis, Jr., 6051 Lee Dr., Cypress, Calif. 90630

[21] Appl. No.: 461,822

[22] Filed: Jan. 8, 1990

[51] Int. Cl.[5] ..... A63B 69/36

[52] U.S. Cl. ..... 273/32 R; 273/162 R

[58] Field of Search ..... 206/315.6, 315.3; 273/162 R, 32 R, 186 A, 194 R, 32 B, 32 E, 32 H

[56] References Cited

U.S. PATENT DOCUMENTS

| | | | |
|---|---|---|---|
| 1,443,230 | 1/1923 | Luckett | 206/315.2 |
| 2,887,137 | 5/1959 | Robb | 206/315.2 |
| 4,545,579 | 10/1985 | McCain | 273/32 R |
| 4,805,911 | 2/1989 | Ferlazzo et al. | 273/32 R |
| 4,832,338 | 5/1989 | Magazzi | 273/32 A |

*Primary Examiner*—George J. Marlo

[57] ABSTRACT

A small hand-held device including a grommet for encircling the handgrip end of a golf club and for supporting a golf club in a generally prone position on a wet grass surface, with the handgrip portion of the club slightly elevated above the tip ends of the blades of grass. The handgrip portion of the club will remain dry (and usable) even though the grass is wet e.g. due to rain and/or sprinkling of the grass and/or early morning dew. The device is useful primarily around the putting greens of the golf course, where a player may wish to carry only a putter and a chipping iron while moving to a ball located a short distance off the green.

5 Claims, 1 Drawing Sheet

GOLF CLUB SUPPORT DEVICE

BACKGROUND AND SUMMARY OF THE INVENTION

This invention relates to an accessory for use with golf clubs.

In the playing of a game of golf, when a golf ball is located a few feet or a few yards off the green the golfer will often not bother to haul his golf bag across or around the green in order to reach the ball. Instead he will carry only a putter and a chipping iron with him when he moves into position to chip the ball onto the green toward the cup. After chipping the ball onto the green the golfer will then lay the chipping iron on the grass bordering the green while he uses the putter to sink the ball.

This procedure presents a problem when the game is being played in the rain or in the early morning hours when the grass may be wet due to early-morning watering by the maintenance crew or the presence of dew on the grass. When the putter or chipping iron is laid on the wet grass the handgrip portion of the golf club will become soaked with water from the grass. The next time the club is used the golfer will have difficulty in properly gripping the club, due to the wet surface condition of the handgrip portion of the club.

The present invention concerns an annular support device that can be temporarily slipped onto the handgrip portion of a golf club to provide a support edge spaced away from the surface of the handgrip portion. When the golf club is laid on (in) wet grass in a prone position the handgrip portion of the club will be elevated a slight distance above the blades of grass, such that the handgrip portion of the club will remain dry even though the grass is wet. The annular support device is removed from the golf club when it is desired to use the golf club for playing purposes.

I am aware of U.S. Pat. No. 1,443,230 to W. Luckett, and U.S. Pat. No. 2,887,137 to A. Robb, and U.S. Pat. No. 4,832,338 to M. Magozzi. These patents show various types of support structures for holding golf clubs in upright positions. The devices of these patents are generally more complicated than the device I am proposing. Also, the patented devices are relatively large and hence not readily transportable. My proposed support device is relatively small, such that is can be stored in the golfer's back pocket; the device is thus easily transported from place to place.

THE DRAWINGS

DESCRIPTION OF A PREFERRED EMBODIMENT OF THE INVENTION

Figure 1:
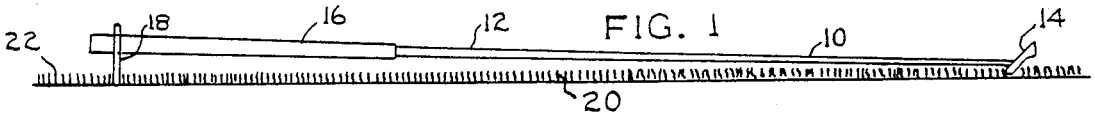
FIG. 1 shows a conventional golf club supported in a prone position by a support mechanism constructed according to may invention.

FIGS. 1 through 4 illustrate a preferred embodiment of my invention. FIG. 5 shows another form that the invention can take. Referring to FIG. 1, there is shown a conventional golf club 10 having a shaft 12 and a ball-contacting head 14. The shaft has a hard rubber (or plastic) sleeve 16 installed thereon to define a handgrip portion of the club. This handgrip portion usually tapers slightly in a left-to-right direction, although it is essentially cylindrical in general outline. The diameter of the handgrip portion is about one inch, although it can vary slightly from one club to another.

As shown in FIG. 1, the golf club is in a prone position, with the club head 14 resting on the ground surface, and with the handgrip portion 16 extending through an annular support mechanism 18 constructed according to my invention. In FIG. 1 numeral 20 references blades of grass projecting above the relatively firm solid ground surface 22. Handgrip portion 16 of the club is shown elevated slightly above the upper tip ends of the grass blades, such that even though the grass may be wet the handgrip portion 16 will remain dry.

Figure 2:
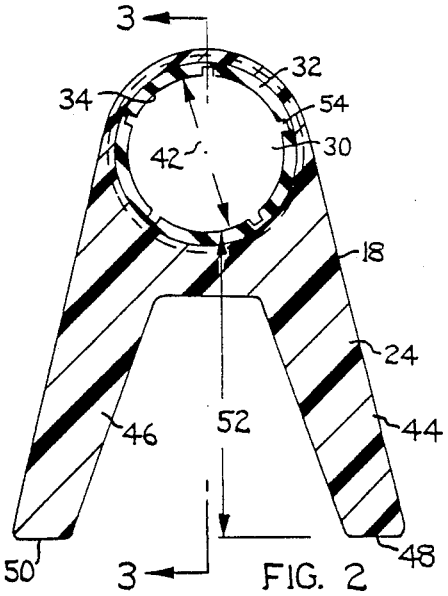
FIG. 2 is an enlarged left end view of the support mechanism shown in FIG. 1.
Figure 3:
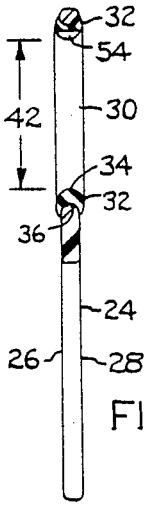
FIG. 3 is a sectional view taken on line 3—3 in FIG. 1.

FIGS. 2 and 3 show some details of support mechanism 18. The mechanism comprises a flat plastic disk 24 having two side faces 26 and 28. A circular hole 30 extends through the disk to interconnect the two disk faces 26 and 28. Seated within hole 30 is an annular elastomeric grommet 32. The preferred grommet material is a soft (low durometer) rubber or sponge rubber, such that the inwardly facing annular surface 34 of the grommet is adapted to resiliently deform when mechanism 18 is slipped onto the handgrip portion of the golf club, as shown in FIG. 1.

Elastomeric grommet 32 has an endless peripheral groove extending therearound that defines a groove bottom surface 36 (FIG. 4) and two facing parallel groove side surfaces 38 and 40. When the grommet is installed on plastic disk 24 the groove bottom surface 36 will be in confronting relation to the edge surface 33 of hole 32; groove side surfaces 38 and 40 will be in gripping engagement with side faces 26 and 28 of the plastic disk.

Figure 4:
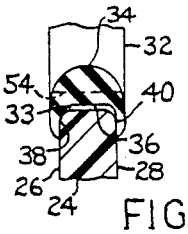
FIG. 4 is a fragmentary sectional view of a structural detail used in the FIG. 2 support mechanism.
Figure 5:
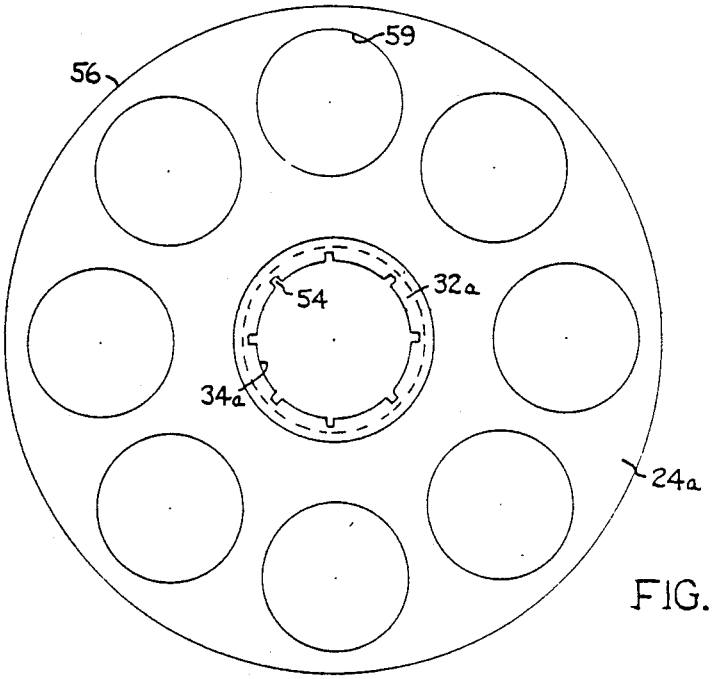
FIG. 5 is an elevational view of another golf club support mechanism embodying the teachings of my invention.

Inwardly facing surface 34 of the grommet has a semi-circular profile, as shown in FIG. 4, such that when mechanism 18 is inserted onto (over) the handgrip portion of a golf club the curved surface 34 will readily slip onto the golf club surface even through handgrip portion 16 of the club has a diameter that is slightly greater than the smallest dimension of the grommet hole, referenced by the numeral 42 (FIG. 3). The resilience of the grommet material enables the grommet to fit onto a range of different golf club handgrip sizes.

In use, the support mechanism is slipped over the club until it is one or two inches along handgrip portion 16, as shown in FIG. 1. Grommet 32 should grip the club surface without allowing support mechanism 18 to slide to the right off of handgrip portion 16. With mechanism 18 inserted onto the club, the club is laid on the ground surface such that handgrip portion 16 is elevated slightly above grass blades 20. Plastic disk 24 has an inverted V configuration, as shown in FIG. 2; legs 44 and 46 of the V extend away from the apex area of the V to form two laterally spaced support edges 48 and 50. The golf club will be laid on the ground so that support edges 48 and 50 engage the ground surface. The general spacing 52 between the support plane (edges 48 and 50) and the inner surface 34 of grommet 32 is such that handgrip portion 16 of the golf club is elevated slightly above grass blades 20. Spacing dimension 52 should be no less than about one inch and no more than about three inches; spacing 52 is preferably about two inches. The upper limit on spacing is necessitated primarily by the desire to make mechanism 18 fit into a golfer's back pocket. The overall height of the mechanism will preferably be approximately three and one half inches, and the overall width will be about two and one half inches.

In order to enhance the ability of the grommet 32 to deflect when grommet surface 34 contacts the club surface, the grommet may have a series of slots 54 formed in surface 34; FIG. 2 shows five such slots, although a greater number of slots may be employed, depending on the durometer of the grommet material. Slots 54 interrupt the grommet annular surface 34, and subdivide said surface into segments that are more readily deformable than would be a continuous annular surface. Deformability is also enhanced by the semi-circular profile of surface 34 (FIG. 4).

FIG. 5 illustrates another form that the invention can take. The FIG. 5 mechanism comprises a flat plastic disk 24*a* having a circular plan configuration. The outer peripheral edge 56 of the disk forms a ground-engagement supporting edge for the mechanism. An annular elastomeric grommet 32*a* is seated in a central hole in disk 24*a* to provide an inwardly facing deformable surface 34*a* adapted to engage the handgrip portion of a golf club. Grommet 32*a* is similar to grommet 32, except that it has eight slots 54 rather than five slots. Through openings 59 may be formed in plastic disk 24*a* for weight reduction purposes (ease in carrying and less material cost for the plastic).

The FIG. 5 construction is advantageous in that when the FIG. 5 mechanism is installed on a golf club the club can be laid (dropped) onto a wet grass surface without any precise orientation of disk 24*a* relative to the ground. No matter what point along edge 56 strikes the ground the club will have its handgrip portion elevated above the wet grass blades. However, the circular shape of disk 24*a* increases the overall size of the mechanism compared to the size obtainable with the FIG. 2 V configuration. The diameter of disk 24 will be on the order of five inches.

With either form of the invention (FIG. 2 or FIG. 5) the prone golf club has its handgrip elevated above the grass plane. The handgrip portion is prevented from getting wet by the grass. Also, the golf club has a greater visual exposure, such that it is less likely to be forgotten or mislaid.

The drawings show two specific forms that the invention can take. It will be appreciated that the invention can be practiced in other forms. The device of the invention is useful primarily on putters and chipping irons.

What is claimed is:

1. A support mechanism for slightly elevating the handgrip portion of a prone golf club from a wet grass surface, comprising a flat disk having two flat side faces and a hole extending through the disk in interconnecting relationship to the disk faces; an annular elastomeric grommet having a peripheral groove therearound that defines an annular groove bottom surface and two facing parallel side faces; said elastomeric grommet being mounted in said hole, with the groove bottom surface confronting the edge surface of the hole and the groove side surfaces in gripping engagement with the disk side faces; said grommet having a radially inwardly facing annular surface adapted to grip the handgrip portion of a golf club; said disk having at least one outer supporting edge thereof spaced from the inwardly facing surface of the grommet by a distance not less than one inch and not more than three inches, whereby when the golf club is laid on wet grass said outer support edge of the disk will engage the ground surface to space the handgrip portion of the club above the tips of the grass blades.

2. The support mechanism of claim 1, wherein the inwardly facing surface of the elastomeric grommet has a semi-circular profile.

3. The support mechanism of claim 1, and further comprising a series of circumferentually spaced slots in the inwardly facing surface of the grommet, whereby said inwardly facing grommet surface has an enhanced ability to deflect when said grommet surface makes contact with the handgrip portion of a golf club.

4. The support mechanism of claim 3, wherein there are at least five circumferentially spaced slots in the inwardly facing grommet surface.

5. The support mechanism of claim 1, wherein said disk has an inverted V-configuration; the hole in the disk being located at the apex of the V, and the outer tip edges of the V constituting disk support edges adapted to engage the ground surface to raise the handgrip portion of the golf club above the grass plane; said out tip edges of the V configuration disk being spaced from the inwardly facing surface of the grommet by a distance of approximately two inches.

* * * * *